United States Patent [19]

Kawanishi et al.

[11] 4,032,463

[45] June 28, 1977

[54] LIQUID DEVELOPER FOR USE IN ELECTROSTATIC PHOTOGRAPHY AND PREPARATION OF SAME

[75] Inventors: Toshiyuki Kawanishi; Norimasa Sohmiya, both of Tokyo, Japan

[73] Assignee: Kabushiki Kaisha Ricoh, Tokyo, Japan

[22] Filed: Apr. 12, 1976

[21] Appl. No.: 676,055

Related U.S. Application Data

[63] Continuation-in-part of Ser. No. 436,638, Jan. 25, 1974, abandoned, which is a continuation-in-part of Ser. No. 328,964, Feb. 2, 1973, abandoned.

[30] Foreign Application Priority Data

Feb. 4, 1972 Japan ..... 47-12189

[52] U.S. Cl. ..... 252/62.1 L

[51] Int. Cl.² ..... G03G 9/12

[58] Field of Search ..... 252/62.1 L, 62.1 R, 252/62.1 P

[56] References Cited

UNITED STATES PATENTS

| | | | |
|---|---|---|---|
| 3,623,986 | 11/1971 | Machida et al. | 252/62.1 L |
| 3,657,130 | 4/1972 | Machida et al. | 252/62.1 L |
| 3,689,260 | 9/1972 | Honjo et al. | 96/1.2 |

FOREIGN PATENTS OR APPLICATIONS

| | | | |
|---|---|---|---|
| 2,012,108 | 3/1970 | France | 252/62.1 L |

*Primary Examiner*—Harris A. Pitlick

*Attorney, Agent, or Firm*—Cooper, Dunham, Clark, Griffin & Moran

[57] ABSTRACT

Liquid developers for use in electrostatic photography in which toner particles comprising pigment and specific polymer mixes having a particle size of from 0.2 to 0.8 μ, and a particle size distribution such that about 90% of the particles are in the particle size range of from 0.3 to 0.6 μ, are dispersed in a petroleum aliphatic hydrocarbon solvent having a solubility parameter of from 7.0 to 7.5, and method of preparation.

5 Claims, 1 Drawing Figure

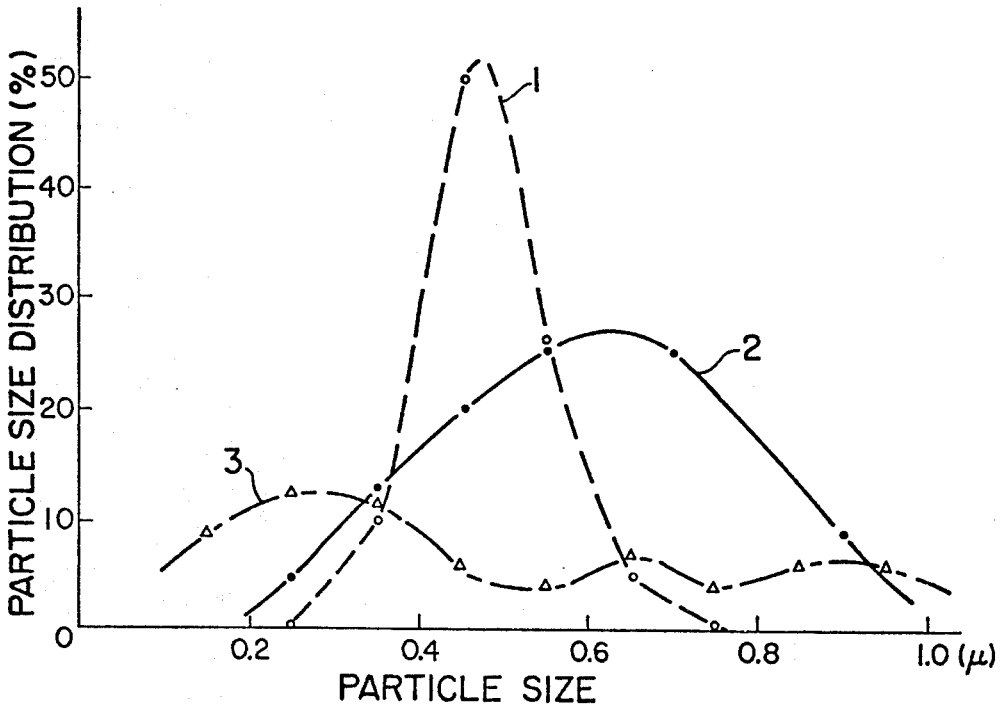
PARTICLE SIZE DISTRIBUTION (%)
50
40
30
20
10
0
0.2
0.4
0.6
0.8
1.0 (μ)
PARTICLE SIZE
1
2
3

LIQUID DEVELOPER FOR USE IN ELECTROSTATIC PHOTOGRAPHY AND PREPARATION OF SAME

RELATED APPLICATIONS

This application is a continuation-in-part of application Ser. No. 436,638 filed Jan. 25, 1974 now abandoned, which is in turn a continuation-in-part of application Ser. No. 328,964 filed Feb. 2, 1973 now abandoned.

BACKGROUND OF THE INVENTION

A. Field of the Invention

This invention relates to liquid developers for use in electrostatic photography and to methods of manufacturing the same. The toner particles in the liquid developers are characterized by specific mean particle sizes of from 0.2 to 0.8 $\mu$, and a particle size distribution such that about 90% of the particles are in the particle size range of from 0.3 to 0.6 $\mu$.

B. Description of the Prior Art

Wet-process electrophotography is preferred over the dry process because of advantages with respect to edge effects and reproducibility of the original image. Liquid developers for use in wet-process electrophotography are usually manufactured by blending pigments, high-molecular weight resins and a solvent, and subsequently dispersing the resulting blend in a petroleum hydrocarbon. A wide variety of resins and pigments have been employed. Utilizing conventional methods of manufacturing, the toners obtained usually have a mean particle size of from 0.4 to 0.7 $\mu$, but because of their wide range of particle size distribution, the resulting developers are so unstable that, when utilized for copying, the resulting images have poor contrast and stained backgrounds. Attempts to solve this problem by improving the solubility and hence the dispersibility of the resin have not been successful, because it is necessary to reduce the mean particle size of the toners to a range of about 0.1 to 0.3 $\mu$. As a result, it is very difficult to produce copies having high image density.

SUMMARY OF THE INVENTION

The present invention provides liquid developers for use in electrostatic photography comprising toner particles dispersed in a petroleum aliphatic hydrocarbon solvent having a solubility parameter of from 7.0 to 7.5. The toners have a mean particle size of from 0.2 to 0.8 $\mu$ and a particle size distribution such that about 90% of the particles are in the particle size range of from 0.3 to 0.6 $\mu$. The toners comprise a mixture of at least one pigment together with a mixture of Polymer A and Copolymer B. Polymer A has a molecular weight of from 10,000 to 200,000. Copolymer B has a molecular weight of from 5,000 to 30,000 and a solubility parameter of from 7.5 to 8.7. The weight ratio of Polymer A to Copolymer B is from 0.1:1–20:1. Polymer A is a homopolymer or a copolymer containing monomers represented by the general formula $$CH_2{=}\underset{\underset{Y}{|}}{C}{-}X \qquad \text{I:}$$

wherein X represents H or $CH_3$, and Y represents

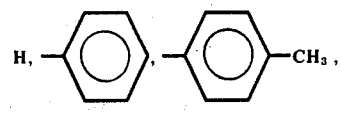

COOH, $COOC_nH_{2n+1}$ (wherein $n$ is an integer ranging from 9 to 20), $-CH=CH_2$.

Copolymer B contains monomers represented by the general formulas $$CH_2{=}\underset{\underset{COOC_nH_{2n+1}}{|}}{C}{-}X \qquad \text{II:}$$

wherein X represents H or $CH_3$, and n is an integer ranging from 6 to 20; and $$CH_2{=}\underset{\underset{Z}{|}}{C}{-}X \qquad \text{III:}$$

wherein X represents H or $CH_3$, and Z represents

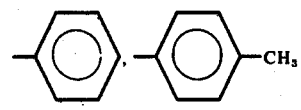

or $COOC_nH_{2n+1}$ (wherein n is an integer ranging from 1 to 5).

In Copolymer B, the molar ratio of the components represented by Formula III to those of Formula II is from 50–95:50–5. When the ratio is appreciably outside of this range it is difficult to produce toners of the desired particle size.

The presently preferred process for the production of the liquid developers of this invention comprises the steps of:

1. Mixing a pigment, a solvent having a solubility parameter of from 7.0 to 7.5 which is a petroleum aliphatic hydrocarbon solvent which may contain up to 25% (preferably 5 to 15%) by weight of an aromatic hydrocarbon, and Polymer A in the weight ratio of 3–15:55–95:1–30;
2. Mixing the product of Step 1 with Copolymer B, in the weight ratio of Polymer A to Copolymer B of from 0.1:1–20:1, and
3. Dispersing the product from Step 2 in a petroleum aliphatic hydrocarbon solvent having a solubility parameter of from 7.0 to 7.5.

The term Solubility Parameter (S.P.) as used herein is described and defined in Polymer Handbook: Brandrup and Immergut, Interscience Publishers 1966, pages 341–346.

Polymer A is employed for the purpose of providing sufficient fixability to the toner. Presently preferred examples of Polymer A include styrene-butadiene, lauryl methacrylate-acrylic acid, vinyl toluene-butadiene, stearyl methacrylate-ethylene and butadiene-alkyl acrylate copolyers and butadiene polymer.

Typical aromatic hydrocarbons applicable in the present invention include toluene, xylene, etc., and the petroleum aliphatic hydrocarbon applicable in the present invention includes such known commercial products as Isopar E, F, G, H, I, K and L (manufactures of ESSO Standard Oil Co., Ltd.), SHELLZOL (a manufacture of SHELL Oil Co., Ltd.), etc.

The properties of the Isopar products are:

B.P. Range:116°–208° C.

S.P.:7.0–7.3

Carbon Atoms:$C_{11}$–$C_{13}$ isoparaffinic hydrocarbons

The properties of the Shellzol products are:

B.P. Range:180°–207° C.

S.P.:7.3

Carbon Atoms:$C_{11}$–$C_{13}$ isoparaffinic hydrocarbons

The blend of Step 1 is prepared under ordinary conditions for blending, e.g., by blending in a ball-mill having a ball diameter of 6–10 mm for 20–8 hours.

Copolymer B products have a solubility parameter of 7.5–8.7 and a molecular weight of 5000–30000. Presently preferred examples include 2-ethyl hexyl methacrylate-methyl acrylate, 2-ethyl hexyl methacrylate-isobutyl methacrylate, lauryl methacrylate-ethyl acrylate, stearyl methacrylate-methyl methacrylate, lauryl methacrylate-styrene and 2-ethyl hexyl methacrylate-vinyl toluene-isobutyl methacrylate copolymer. As the pigment for use in the present invention, any of the known pigments normally employed in the production of toners, such as spirit black, Cyanine Black, etc., are applicable.

It has been discovered that if the solubility parameter of Copolymer B is less than 7.5, the particle size of the resulting toners is too small, while if it exceeds 8.7, the particle size of the resulting toners is too large. If the molecular weight is less than 5000, it is difficult to control the particle size of the resulting toner, and there is a widening of the particle size distribution, while in case the molecular weight exceeds 30000, partial aggregation of the toner particles takes place and there is impairment of the stability of the resulting developer.

Typical toners of this invention prepared as described above has a mean particle size of 0.2–0.8 $\mu$ and a particle size distribution as follows: 2% of 0.2–0.3 $\mu$ particles; 10% of 0.3–0.4 $\mu$ particles; 52% of 0.4–0.5 $\mu$ particles; 28% of 0.5–0.6 $\mu$ particles; 6% of 0.6–0.7 $\mu$ particles; 2% of 0.7–0.8 $\mu$ particles.

The following non-limiting examples are given by way of illustration only.

EXAMPLE 1

| | |
|---|---|
| Carbon black | 1 part by weight |
| Vinyl toluene butadiene copolymer (mol ratio = 50:50, m.w. 100,000) | 2 parts by weight |
| Toluene | 1 part by weight |
| Isopar H | 4.5 parts by weight |

By blending the above components by means of a ball-mill having the ball diameter of 8 mm for 23 hours, a Blend (A) of toner particles having a mean diameter of 0.6 $\mu$ was prepared. Next, a mixture containing the following components was blended by means of a ball-mill having the ball diameter OF 8 mm for 1 hour to prepare a product of the invention, Blend (B)

| | |
|---|---|
| Blend (A) | 2 parts by weight |
| Isobutyl methacrylate-2-ethyl hexyl methacrylate copolymer (mol ratio = 80:20, mean molecular weight = 10800) | 1 part by weight |
| Isopar H | 2 parts by weight |

25 g of a concentrated toner (0.48 $\mu$ in the mean diameter of particle) i.e. Blend (B) thus obtained were dispersed in 1 $l$ of Isopar H, whereby a liquid developer for use in electrostatic photography was prepared. When the toner particle size distribution of this developer was measured, it was as shown by curve 1 in the appended drawing. Beside, the developer kept the state of stable dispersion for more than one week. Further, when this developer was employed for development of an electrophotographic material having electrostatic latent image, there was obtained a distinct image.

For the purpose of comparison, a liquid developer was prepared by dispersing 5 g of Blend (A) obtained in the present example in 1 $l$ of Isopar H. When the toner particle size distribution of this developer was measured, it was as shown by curve 2 in the appended drawing (0.6 $\mu$ in the mean diameter of toner particle). In the case of this developer, toner particles precipitated to the bottom of the liquid in three days and the upper part of the liquid became pervious to light. When employed for copying, the image area was coarse, the resolving power was poor, and the background showed a high concentration resulting in poor contrast.

Also for the purpose of comparison, the following components were blended by means of a ball-mill having the ball diameter of 8 mm for 23 hours to prepare Blend (C).

| | |
|---|---|
| Carbon black | 1 part by weight |
| Vinyl toluene butadiene copolymer (mol ratio = 50:50) | 2 parts by weight |
| Isobutyl methacrylate-2-ethyl hexyl methacrylate copolymer (mol ratio = 80:20, mean molecular weight = 10800) | 4.25 parts by weight |
| Toluene | 1 part by weight |
| Isopar H | 12 parts by weight |

Then, 5 g of Blend (C) were dispersed in 1$l$ of Isopar, whereby another liquid developer was prepared. This liquid developer comprises the same components as that of the liquid developer in the present example, but the particle size distribution thereof was as shown by curve 3 in the appended drawing.

In the case of this comparative developer, toner particles precipitated in about 1 day, so that it was of no practical use.

Isopar H is an isoparaffinic hydrocarbon with a flash point of 123° F., Kauri-Butanol value of 27, and a specific gravity of 0.7571.

EXAMPLE 2

| | |
|---|---|
| Carbon black | 0.7 part by weight |
| Cyanine Blue KR (SANYO COLOR WORKS LTD in Japan) | |
| Styrene butadiene copolymer (mol ratio = 25 : 75, m.w. Ca 100,000) | 1 part by weight |
| Toluene | 2 parts by weight |
| Isopar H | 6 parts by weight |

By blending the above components in a ball-mill with the same ball diameter as in Example 1 for 48 hours, a blend of toner particles having a size range of 0.2–0.8 $\mu$ and a mean diameter of 0.55 $\mu$ was prepared.

This was converted to a product of the invention by mixing:

| | |
|---|---|
| The blend prepared in the foregoing | 2 parts by weight |
| Ethylmethacrylate ~ lauryl-methacrylate copolymer (mol ratio = 50 : 50, mean molecular weight = 12000) | 1 part by weight |
| Isopar H | 2 parts by weight |

By ball-milling a mixture of above components for 2 hours, a concentrated toner (0.2~0.6 $\mu$ in the particle diameter range and 0.45 $\mu$ in the mean diameter of particle) was obtained. The successive precedures were the same as in Example 1 to prepare a liquid developer having a stable dispersion of toner particles.

EXAMPLE 3

| | |
|---|---|
| Orasol Red B (CIBA LTD in Switzerland) | 1 part by weight |
| Laurylmethacrylate homopolymer (means molecular weight 50,000) | 2 parts by weight |
| Toluene | 1 part by weight |
| Isopar G | 3 parts by weight |

By blending the above components in a ball-mill for 48 hours, as in the previous example, there was obtained a blend of toner particles with a particle diameter range of 0.3–1.0 $\mu$, and a mean particle diameter of 0.70 $\mu$.

This was converted to a product of the invention by mixing:

| | |
|---|---|
| The blend prepared in the foregoing | 2 parts by weight |
| Styrene stearyl methacrylate copolymer (mol ratio = 95 : 5, mean molecular weight 8000) | 1 part by weight |
| Isopar G | 3 parts by weight |

By milling a mixture of above components in a ball-mill, as described above, for 5 hours, a concentrated toner (0.2~0.7 $\mu$ in particle diameter range and 0.45 $\mu$ in particle diameter range and 0.45 $\mu$ in mean diameter of particle) was obtained. The successive procedures were as described in Example 1 to prepare a liquid developer having a stable dispersion of toner particles.

EXAMPLE 4

| | |
|---|---|
| Benzidine Yellow GR (TOYO INK Co., LTD. in Japan) | 1 part by weight |
| Laurylmethacrylate acrylic acid copolymer (mol ratio = 50 : 50, mean molecular weight 12,000) | 1 part by weight |
| Toluene | 2 parts by weight |
| Shellzol | 4 parts by weight |

By blending the above components for 40 hours in a ball-mill, as described above, there was obtained a bland of toner particles having particle diameter range of 0.3–1.2 $\mu$ and a mean particle diameter of 0.85 $\mu$.

This was converted to a product of the invention by mixing:

| | |
|---|---|
| The blend prepared in the foregoing | 2 parts by weight |
| 2-ethyl hexylmethacrylate~vinyl-toluene~isobuthyl methacrylate copolymer (mol ratio = 50 : 30 : 20) | 1 part by weight |
| Shellzol | 2 parts by weight |

By milling the above components for 8 hours in a ball-mill, as described above, there was obtained a concentrated tone (0.2~0.8 $\mu$ in particle diameter range and 0.45 $\mu$ in mean diameter of particle). The successive procedures were as described in Example 1 to prepare a liquid developer having a stable dispersion to toner particles.

Note: In Example 4 it is to be noted that the ratio of 2-ethylhexylmethacrylate (formula II)/ a mixture of vinyl-toluene with isobutylmethacrylate (both formula III) is equal to 50:50.

BRIEF DESCRIPTION OF THE DRAWING

The FIGURE in the appended drawing shows curves illustrative of the relation between the diameter of toner particle and the particle size distribution with respect to the toner under the present invention in the foregoing examples and the comparative toners.

What is claimed is:

1. A liquid developer for use in electrostatic photography comprising toner particles dispersed in a petroleum aliphatic hydrocarbon solvent having a solubility parameter of from 7.0 to 7.5; said toners having a mean particle size of from 0.2 to 0.8 $\mu$, and a particle size distribution such that about 90% of the particles are in the particle size range of from 0.3 to 0.6 $\mu$; said toners comprising at least one pigment together with a mixture of Polymer A and Copolymer B, Polymer A having a molecular weight of from 10,000 to 200,000, Copolymer B having a molecular weight of from 5,000 to 30,000 and a solubility parameter of from 7.5 to 8.7, the weight ratio of Polymer A to Copolymer B being from 0.1:1–20:1, said Polymer A being a homopolymer or a copolymer containing monomers represented by the general formula

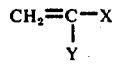

I:

wherein X represents H or $CH_3$, and Y represents

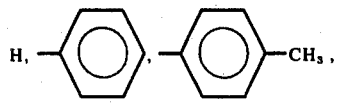

COOH, $COOC_nH_{2n+1}$ (wherein n is an integer ranging from 9 to 20), $-CH{=}CH_2$;

said Copolymer B containing monomers represented by the general formulas

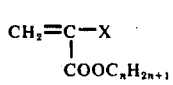

II:

wherein X represents H or $CH_3$, and n is an integer ranging from 6 to 20; and

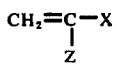

III:

wherein X reprsents H or $CH_3$, and Z represents

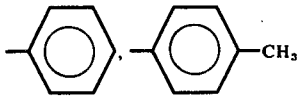

or $COOC_nH_{2n+1}$ (wherein *n* is an integer ranging from 1 to 5);

the molar ratio of Formula III/Formula II being 50–95:-50–5.

2. A developer according to claim 1, wherein Polymer A is selected from the group consisting of styrene-butadiene, lauryl methacrylate-acrylic acid, vinyl toluene-butadiene, stearyl methacrylate-ethylene, and butadiene-alkyl acrylate copolymers and butadiene polymer, and Copolymer B is selected from the group consisting of 2-ethyl hexyl methacrylate-methyl acrylate, 2-ethyl hexyl methacrylate-isobutyl methacrylate, lauryl methacrylate-ethyl acrylate, stearyl methacrylate-methyl methacrylate, lauryl methacrylate-styrene and 2-ethyl hexyl methacrylate-vinyl toluene-isobutyl methacrylate copolymers.

3. A process for the production of a liquid developer containing dispersed toner particles having a mean particle size of from 0.2 to 0.8 $\mu$, and a particle size distribution such that about 90% of the particles are in the size range of from 0.3 to 0.6 $\mu$ for use in electrostatic photography which comprises the steps of:

1. Mixing a pigment and a Polymer, A, in a solvent having a solubility parameter of from 7.0 to 7.5 being a petroleum aliphatic hydrocarbon solvent containing up to 25% by weight of an aromatic hydrocarbon, said Polymer A having a molecular weight of from 10,000 to 200,000 and being a homopolymer or a copolymer containing monomers represented by the general formula

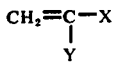

I:

wherein X represents H or $CH_3$, and Y represents

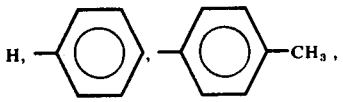

COOH, $COOC_nH_{2n+1}$ (wherein n is an integer ranging from 9 to 20), $—CH=CH_2$, the weight ratio of pigment to solvent to Polymer A being 3-15:55-95:1-30;

2. Mixing the product of Step 1 with Copolymer B, said Copolymer B having a molecular weight of from 5,000 to 30,000 and a solubility parameter from 7.5 to 8.7, the weight ratio of Polymer A to Copolymer B being from 0.1:1–20:1, said Copolymer B containing monomers represented by the general formulas

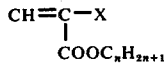

II:

wherein X represents H or $CH_3$, and n is an integer ranging from 6 to 20; and

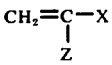

III:

wherein X represents H or $CH_3$, and Z represents

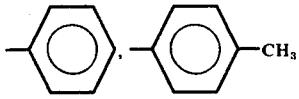

or $COOC_nH_{2n+1}$ (wherein n is an integer ranging from 1 to 5), the molar ratio of Formula III/Formula II being 50–95:50–5, and 3. Dispersing the product from Step 2 in a petroleum aliphatic hydrocarbon solvent having a solubility parameter of from 7.0 to 7.5.

4. A process according to claim 3 wherein the solvent utilized in Step 1 contains from 5 to 15% by weight of an aromatic hydrocarbon solvent.

5. A process according to claim 3, wherein Polymer A is selected from the group consisting of styrene-butadiene, lauryl methacrylate-acrylic acid, vinyl toluene-butadiene, stearyl methacrylate-ethylene, and butadiene-alkyl acrylate copolymers and butadiene polymer, the aromatic hydrocarbon for use in Step 1 is selected from the group consisting of toluene and xylene, and Copolymer B is selected from the group consisting of 2-ethyl hexyl methacrylate-methyl acrylate, 2-ethyl hexyl methacrylate-isobutyl methacrylate, lauryl methacrylate-ethyl acrylate, stearyl methacrylate-methyl methacrylate, lauryl methacrylate-styrene copolymer and 2-ethyl hexyl methacrylate-vinyl toluene-isobutyl methacrylate copolymers.

* * * * *